US011039673B2

(12) United States Patent
Hughes

(10) Patent No.: US 11,039,673 B2
(45) Date of Patent: Jun. 22, 2021

(54) LUGGAGE TOWING APPARATUS

(71) Applicant: Richard D. Hughes, Denver, CO (US)

(72) Inventor: Richard D. Hughes, Denver, CO (US)

( * ) Notice: Subject to any disclaimer, the term of this patent is extended or adjusted under 35 U.S.C. 154(b) by 0 days.

(21) Appl. No.: 16/894,286

(22) Filed: Jun. 5, 2020

(65) Prior Publication Data

US 2020/0297090 A1 Sep. 24, 2020

Related U.S. Application Data

(62) Division of application No. 16/285,858, filed on Feb. 26, 2019, now Pat. No. 10,722,016.

(60) Provisional application No. 62/636,339, filed on Feb. 28, 2018.

(51) Int. Cl.

| | |
|---|---|
| ***A45F 5/00*** | (2006.01) |
| ***A45C 13/26*** | (2006.01) |
| ***A45C 13/38*** | (2006.01) |
| ***A45F 5/02*** | (2006.01) |

(52) U.S. Cl.

CPC ..... *A45C 13/38* (2013.01); *A45C 13/262* (2013.01); *A45F 5/021* (2013.01)

(58) Field of Classification Search

CPC .. A45F 5/102; A45F 5/021; A45F 5/10; A45F 3/14; A45F 5/00; A45F 2005/008; A45F 2005/006; A45C 13/28; A45C 13/262; A45C 13/30; A45C 13/38; B62B 5/068; B65G 7/12

USPC ..... 224/184, 268, 269, 677, 217, 257, 260

See application file for complete search history.

(56) References Cited

U.S. PATENT DOCUMENTS

| | | | | |
|---|---|---|---|---|
| 5,609,283 | A * | 3/1997 | Harrison, Jr. | A45F 5/02 224/678 |
| 10,244,851 | B1 * | 4/2019 | Petersson | A45F 3/02 |
| 2009/0108035 | A1 * | 4/2009 | Obenauf | A47G 25/1457 223/1 |
| 2009/0188955 | A1 * | 7/2009 | Bizzell | A45F 5/00 224/258 |

* cited by examiner

*Primary Examiner* — Adam J Waggenspack

(74) *Attorney, Agent, or Firm* — Roger A. Jackson

(57) ABSTRACT

A luggage towing apparatus, wherein the luggage has a wheel to move on a surface and an opposing handle. The luggage apparatus includes a bracket constructed of a beam having first, mid, and second end portions, the first end portion having an aperture, the second end portion having a flexible hook being removably engagable to the luggage handle. The mid portion has a finger channel constructed of a partial sidewall, wherein the partial sidewall terminates in an open gap that operationally allows a user's finger to pass therethrough wherein the sidewall acts as a finger rest to facilitate finger movement thus moving the bracket to engage and disengage the flexible hook from the luggage handle. The luggage towing apparatus further includes a strap that is affixed the aperture, wherein operationally the strap is looped around a torso of the user to enable pulling the luggage across the surface hands free.

2 Claims, 8 Drawing Sheets

LUGGAGE TOWING APPARATUS

RELATED APPLICATIONS

This application is a divisional of U.S. patent application Ser. No. 16/285,858 filed on Feb. 26, 2019 by Richard D. Hughes of Denver, Colo., U.S., that claims the benefit of U.S. provisional patent application Ser. No. 62/636,339 filed on Feb. 28, 2018 by Richard D. Hughes of Denver, Colo., U.S.

FIELD OF THE INVENTION

The present invention generally relates to luggage accessories. More particularly, the present invention is used with wheeled luggage that is an apparatus that allows for "hands free" wheeled luggage pulling through airport terminals.

DESCRIPTION OF THE RELATED ART

Wheeled luggage are common in airports wherein the luggage typically have a centrally mounted rigid pull handle that the user grasps with one of their hands that puts the user in an awkward semi twisted user torso situation while trying to pull the luggage forward, this requires either constant steering direction corrections as the user's arm is pulling off-center-so that the wheeled luggage tends to tract off-center also or the solution of pulling the luggage off to the side in a straight roll tract, however, this requiring additional muscle stress to pull the luggage out to one side as opposed pulling the luggage directly behind which minimizes additional muscle stress.

Another problem with the conventional wheeled luggage is that the pull handle consumes a hand of the user, leaving only one free hand for the user, which makes carrying other items all the more difficult.

Yet another problem is that with the fixed rigid luggage handle the trailing distance of the wheeled luggage behind the user (especially a user with shorter arms) can cause the user's feet to bump into the wheeled luggage behind them, which can be annoying and could cause the user to trip on the surface.

Looking at the prior art in wheeled pull luggage and related arts in U.S. Pat. No. 5,878,853 to DeRouen et al., discloses a wheeled luggage pull that basically extends the conventional handle of pulled luggage via a triangular piece with a semi-circular piece at the bottom to clamp on the inverted "U" handle of the wheeled luggage. In DeRouen, it looks as though the major benefit is to have the luggage trail behind the user at a greater distance to lessen the chance of the user's feet kicking the luggage as they walk and to have less torso twist on the user when pulling the wheeled luggage.

Further looking at the prior art in wheeled pull luggage and related arts in U.S. Pat. No. 4,838,396 to Krenzel, discloses a luggage handle that has a removably engagable section (see FIG. 6) utilizing a spring clip (element 40) with anchor loop (element 42).

Continuing to look at the prior art in wheeled pull luggage and related arts in U.S. Pat. No. 5,090,691 to Pollock, discloses a handle that could be used as a "T"-handle grip for luggage that would utilize that type of handle.

In addition looking at the prior art in wheeled pull luggage and related arts in U.S. Pat. No. 5,722,118 to Hansen et al, discloses a wheeled pull luggage handle conversion apparatus that includes a rotational pivot to give rotational freedom for manual grasping of the handle, wherein there are a number of embodiments that facilitate different attachments to the original luggage handle as shown in FIGS. 2, 3, 4, 5, 6, 7, and 8.

This helps to give the current state of the art in the wheeled luggage handle pull arts based on the above cited references, as there are many versions of handle modification shown, such that DeRouen has an extension to the original wheeled pull luggage to help alleviate awkward body twist and help prevent kicking of the pulled luggage by the user's feet and Hansen primarily allows twisting of the handle grasping angle for comfort.

None of the above cited references showed a "hands free" option for pulling the wheeled luggage nor the specific type of clamp that would enable "hands free" pulling of the wheeled luggage. Thus what is needed is a luggage towing apparatus that primarily allow for "hands free" pulling of the wheeled luggage, plus in addition the towing apparatus allows for towing of the wheeled luggage directly behind the user to accommodate straight tracking of the wheeled luggage behind the user and to create enough distance of the wheeled luggage and the user to help preclude the user's feet from hitting the wheeled luggage while the user is pulling the wheeled luggage.

SUMMARY OF INVENTION

Broadly, the present invention is a luggage towing apparatus, wherein the luggage has a wheel to move on a surface and an opposing handle. The luggage apparatus includes a bracket constructed of a beam having a first end portion, a mid portion, and an opposing second end portion with a longitudinal axis spanning therebetween, the first end portion having an aperture, the second end portion having a flexible hook that is removably engagable to the luggage handle. Wherein the mid portion has a finger channel constructed of a partial sidewall that is about a channel axis that is perpendicular to the longitudinal axis, wherein the partial sidewall terminates in an open gap that operationally allows a user's finger to pass therethrough wherein the sidewall acts as a finger rest to facilitate finger movement thus moving the bracket along the longitudinal axis to engage and disengage the flexible hook from the luggage handle.

The luggage towing apparatus further includes a strap that is disposed therethrough the aperture, wherein operationally the strap is looped around a torso of the user to enable pulling the luggage across the surface hands free.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 7:
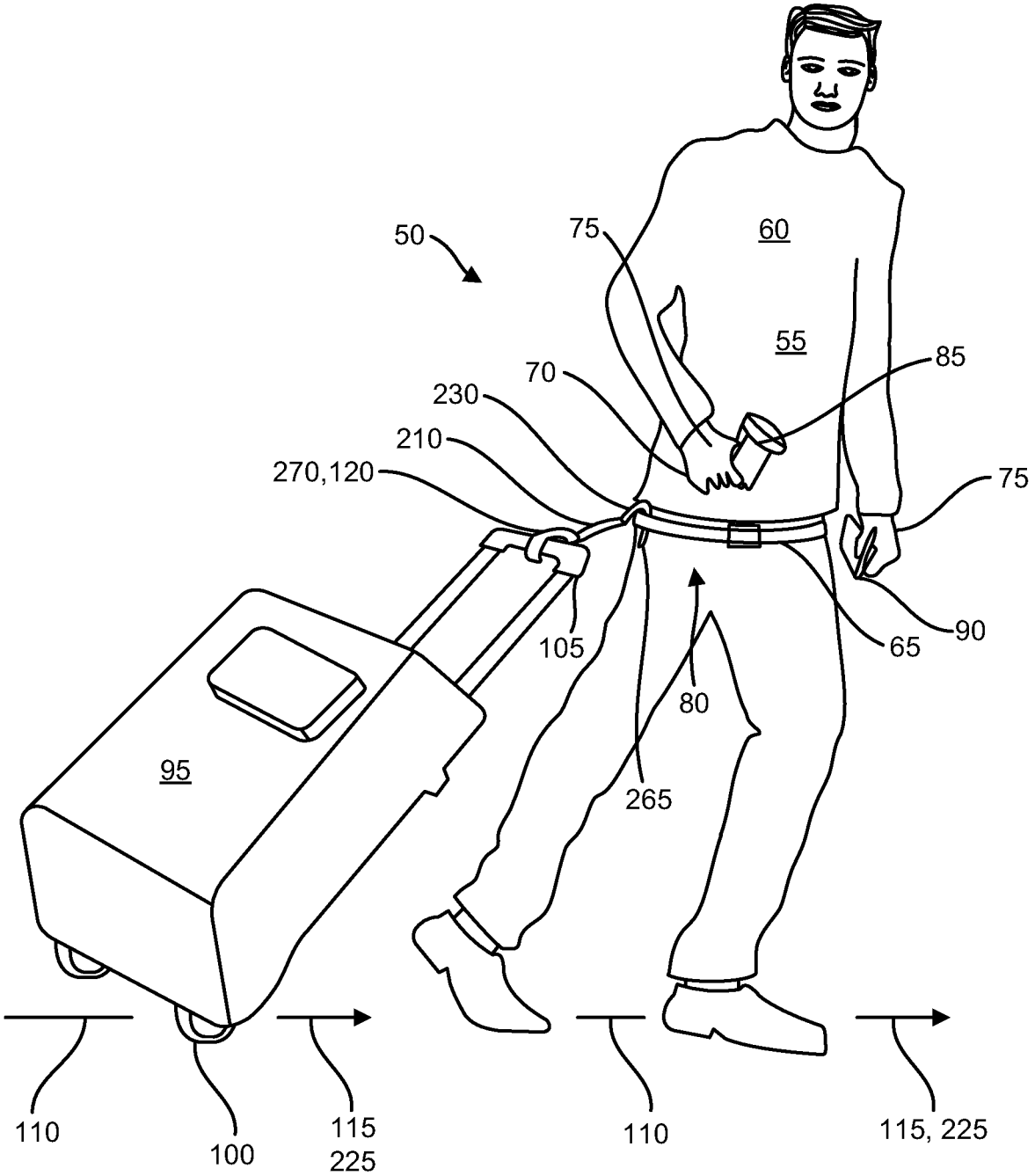
FIG. 7 shows a perspective view of the luggage towing apparatus in use on a surface with the user pulling the wheeled luggage from their waist (could be a belt also) utilizing the clip in conjunction with the strap and either the cradle or the bracket that is removably engaged to the handle of the wheeled luggage, wherein the user is able to pull the wheeled luggage across the surface hands free to enable the user to carry a cup of coffee and travel documents for instance.
Figure 8:
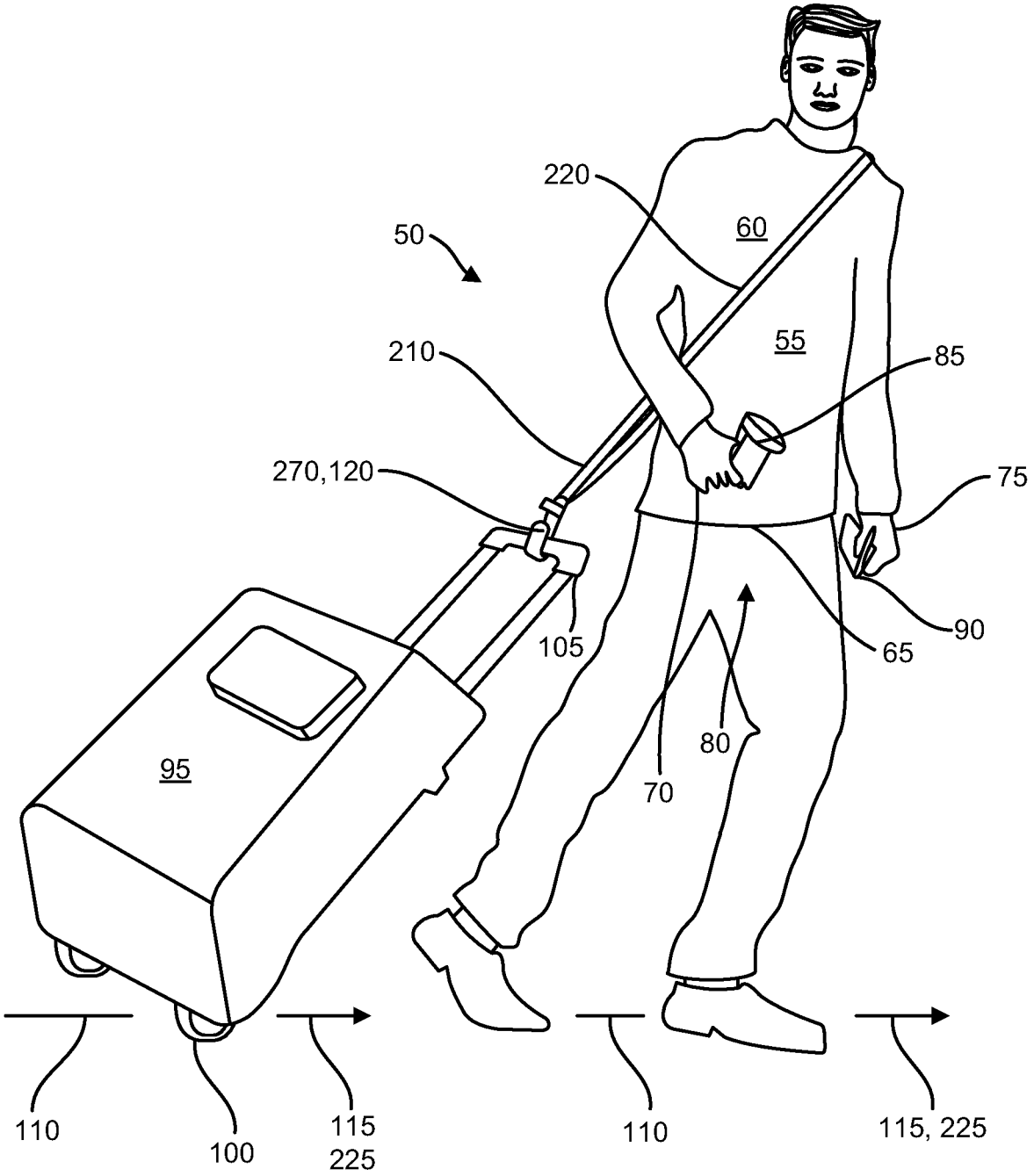
FIG. 8 shows a perspective view of the luggage towing apparatus in use on a surface with the user pulling the wheeled luggage from their torso (could be over or around the shoulder also) utilizing the strap and either the cradle or the bracket that is removably engaged to the handle of the wheeled luggage, wherein the user is able to pull the wheeled luggage across the surface hands free to enable the user to carry a cup of coffee and travel documents for instance.

50 Luggage towing apparatus
55 User
60 Torso of the user 55
65 Waist of the user 55 (belt or pants waist)
70 Finger of the user 55
75 Hand of the user 55
80 Hands free
85 Cup of coffee
90 Travel documents
95 Luggage
100 Wheel on the luggage 95
105 Handle on the luggage 95 positioned opposite of the wheel 100
110 Surface
115 Moving of the luggage 95 along the surface 110 via the wheel 100
120 Bracket
125 Beam of the bracket 120
130 First end portion of the beam 125
135 Mid portion of the beam 125
140 Opposing second end portion of the beam 125
145 Longitudinal axis of the beam 125
150 Aperture of the first end portion 130
155 Flexible hook of the second end portion 140
160 Removably engagable interface of the flexible hook 155 to the handle 105
165 Finger channel of the mid portion 135
170 Partial sidewall of the finger channel 165
175 Channel axis of the finger channel 165
180 Perpendicular position of the channel axis 175 to the longitudinal axis 145
185 Open gap of the partial sidewall 170 that can form a partial closure that terminates inwardly toward the channel axis 175
186 Each open gap 185 forming an inwardly terminating partial closure distance to the channel axis 175
187 Partial sidewall 170 maximum distance from the channel axis 175
190 Finger rest of the partial sidewall 170
195 Finger movement of the finger rest 190
200 Engage the flexible hook 155 to the handle 105
205 Disengage the flexible hook 155 to the handle 105
210 Strap that is conventionally adjustable in length, i.e. to accommodate either of FIG. 7 or 8
215 Strap disposed therethrough the aperture 150
220 Strap looped around the user 55 torso 60
225 Pulling the luggage 95 along the surface 110 hands free 80
230 Clip
235 "U" shaped extension element of the clip 230
240 Primary end portion of the extension element 235
245 Secondary end portion of the extension element 235
250 Flexible catch of the of the second end portion 245
255 Adjacent end of the secondary end portion 245
260 Primary end portion removably engaging the users 55 hand 75
265 Primary end portion removably engaging the user's 55 waist 65
270 Cradle
275 Leg of the cradle 270
280 First end portion of the leg 275
285 Second end portion of the leg 275
290 Longwise axis of the leg 275
295 Clasp of the first end portion 280
300 Open arcuate section of the second end portion 285
305 Removably engagable of the open arcuate section 300 to the handle 105

DETAILED DESCRIPTION

Figure 1:
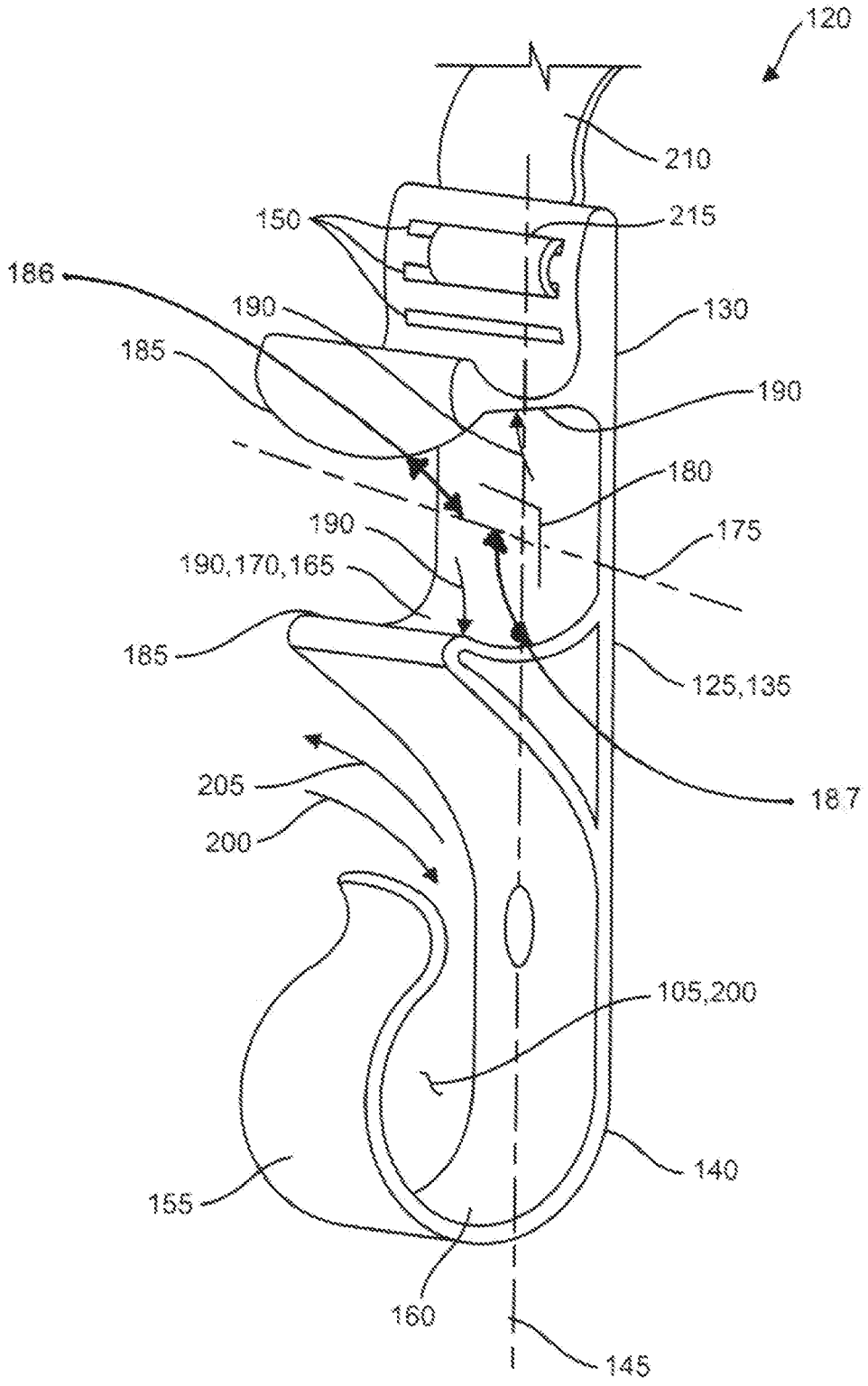
FIG. 1 shows an upper perspective view of a bracket that includes a beam with a first end portion, a mid portion, and an opposing second end portion with a longitudinal axis spanning therebetween, plus an aperture with a strap, also a flexible hook and a finger channel are shown.

With initial reference to FIG. 1 shown is the an upper perspective view of the bracket 120 that includes the beam 125 with the first end portion 130, the mid portion 135, and the opposing second end portion 140 with the longitudinal axis 145 spanning therebetween, plus the aperture 150 with the strap 210, the flexible hook 155, and the finger channel 165.

Figure 2:
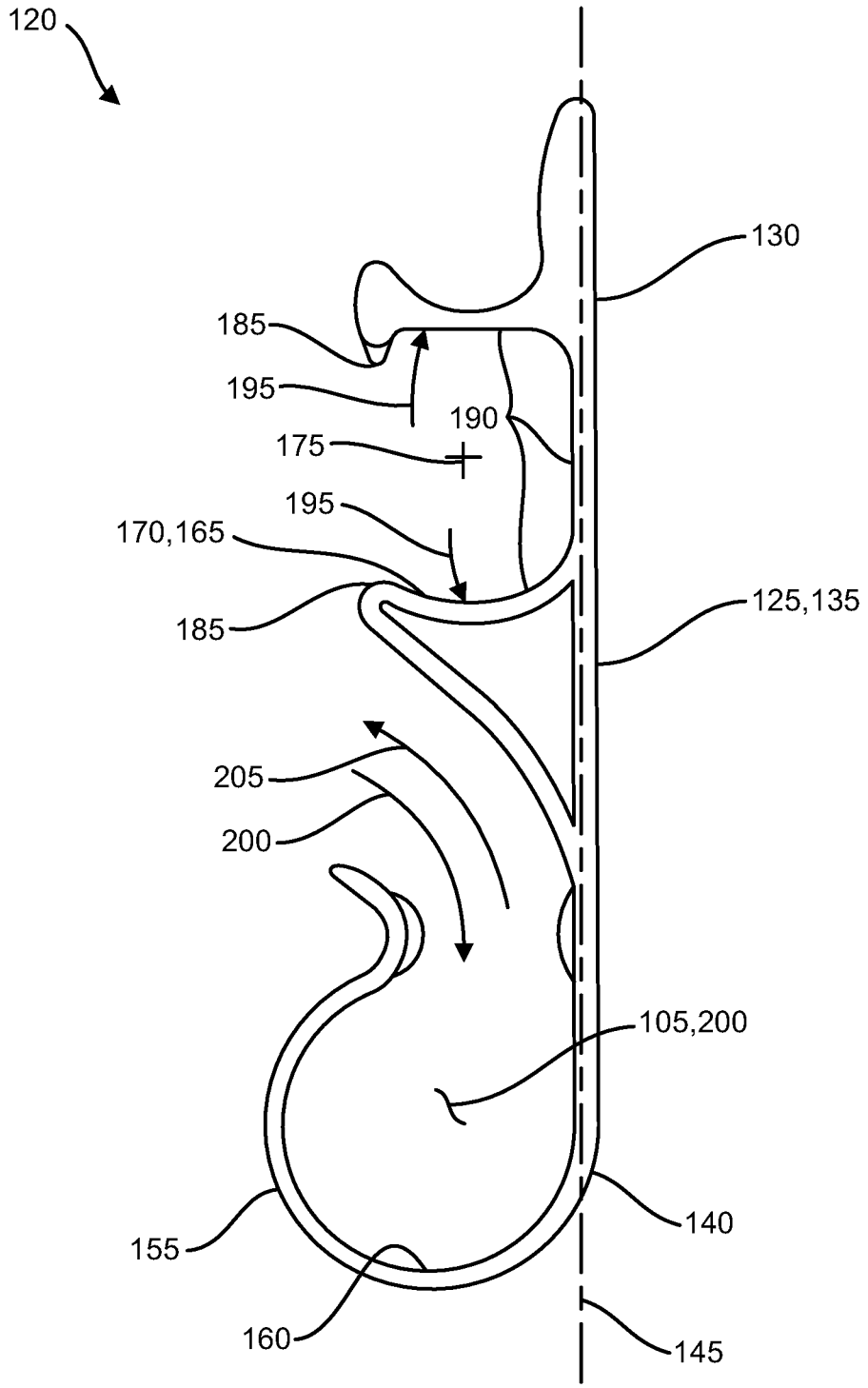
FIG. 2 shows a side elevation view of the bracket that includes the beam with the first end portion, the mid portion, and the opposing second end portion with the longitudinal axis spanning therebetween, plus the aperture, the flexible hook, and the finger channel.

Next, FIG. 2 shows a side elevation view of the bracket 120 that includes the beam 125 with the first end portion 130, the mid portion 135, and the opposing second end portion 140 with the longitudinal axis 145 spanning therebetween, plus the aperture 150, the flexible hook 155, and the finger channel 165.

Figure 3:
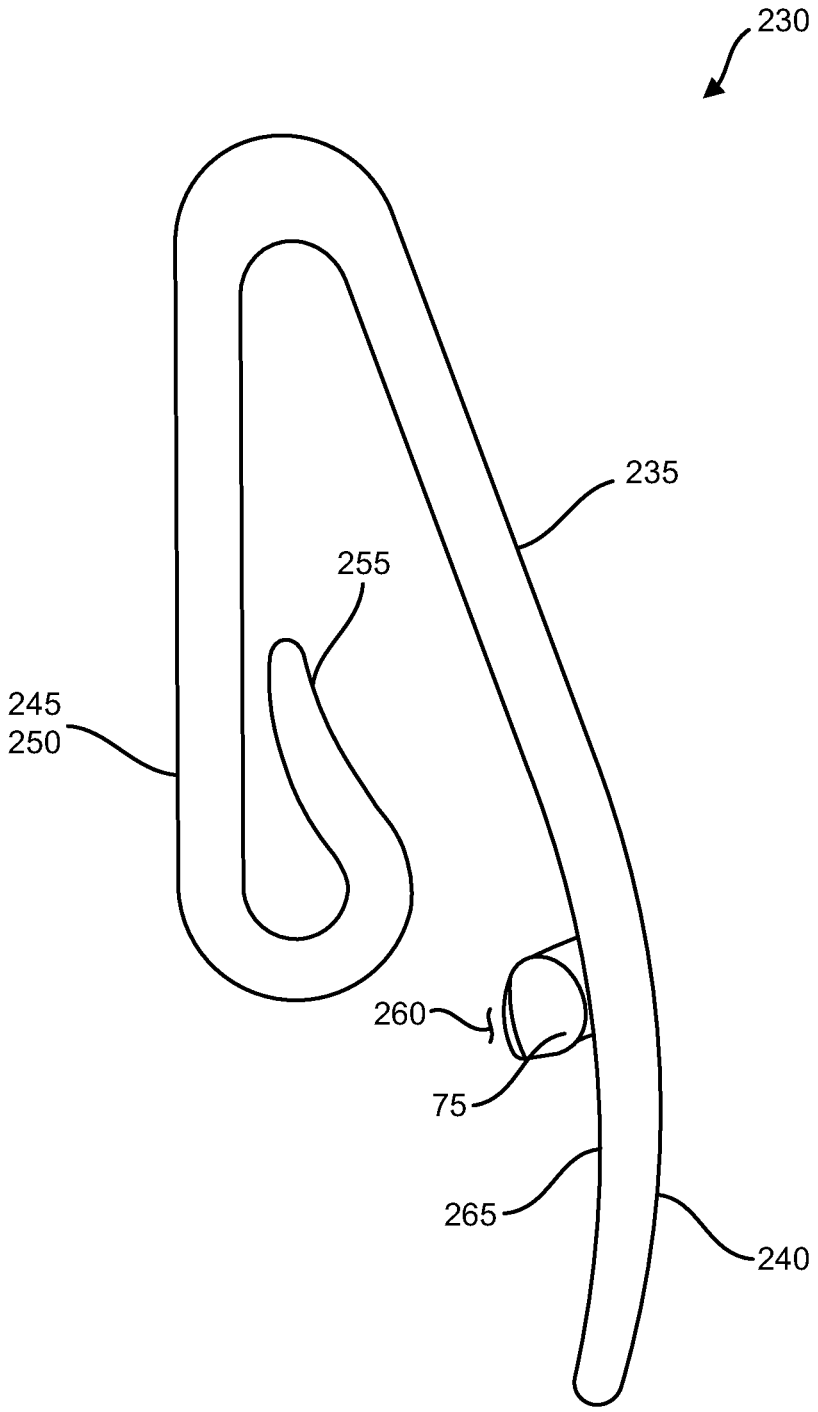
FIG. 3 shows a side elevation view of a clip that includes a "U" shaped extension element with a primary end portion and a secondary end portion that has a flexible catch.

Continuing, FIG. 3 shows a side elevation view of a clip 230 that includes a "U" shaped extension element 235 with the primary end portion 240 and the secondary end portion 245 that has the flexible catch 250.

Figure 4:
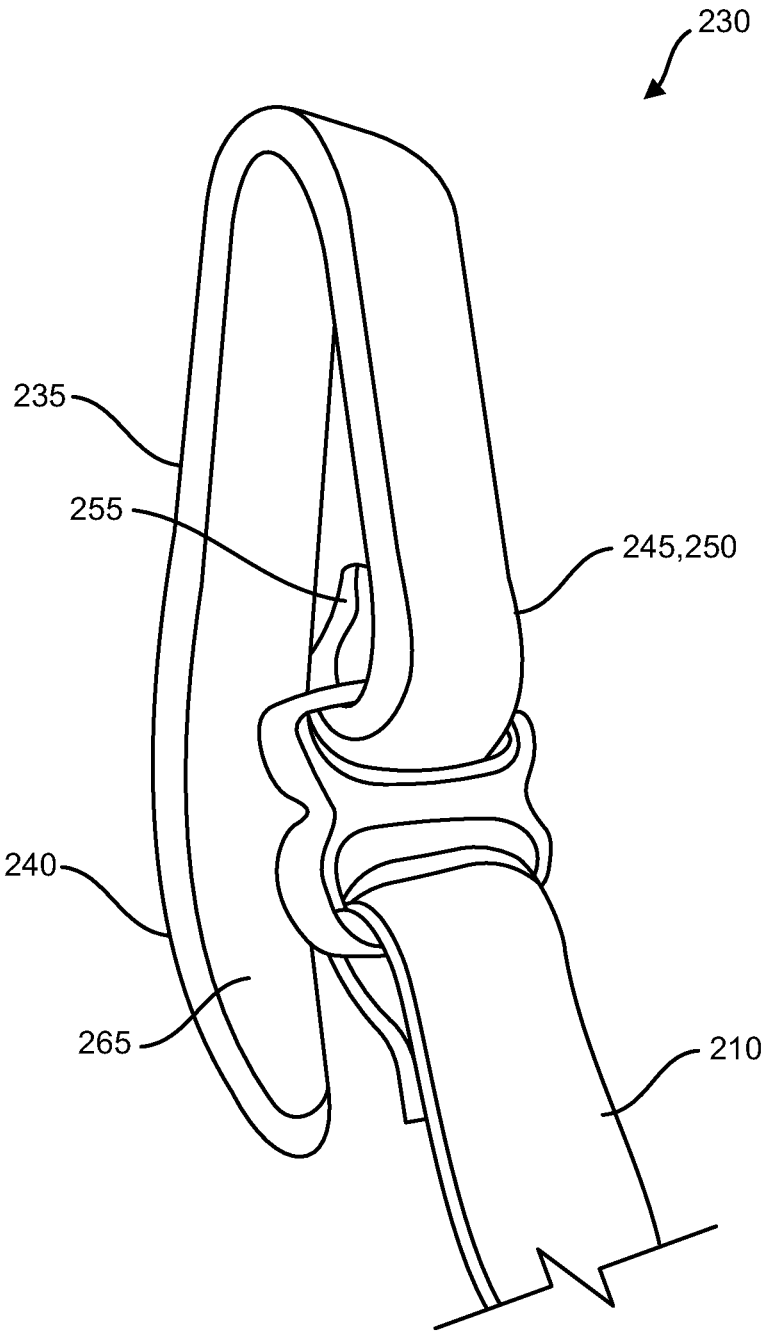
FIG. 4 shows a perspective view of the clip that includes the "U" shaped extension element with the primary end portion and the secondary end portion that has the flexible catch, wherein the strap is shown attached to the secondary end portion.

Further, FIG. 4 shows a perspective view of the clip 230 that includes the "U" shaped extension element 235 with the primary end portion 240 and the secondary end portion 245 that has the flexible catch 250, wherein the strap 210 is shown attached to the secondary end portion 245.

Figure 5:
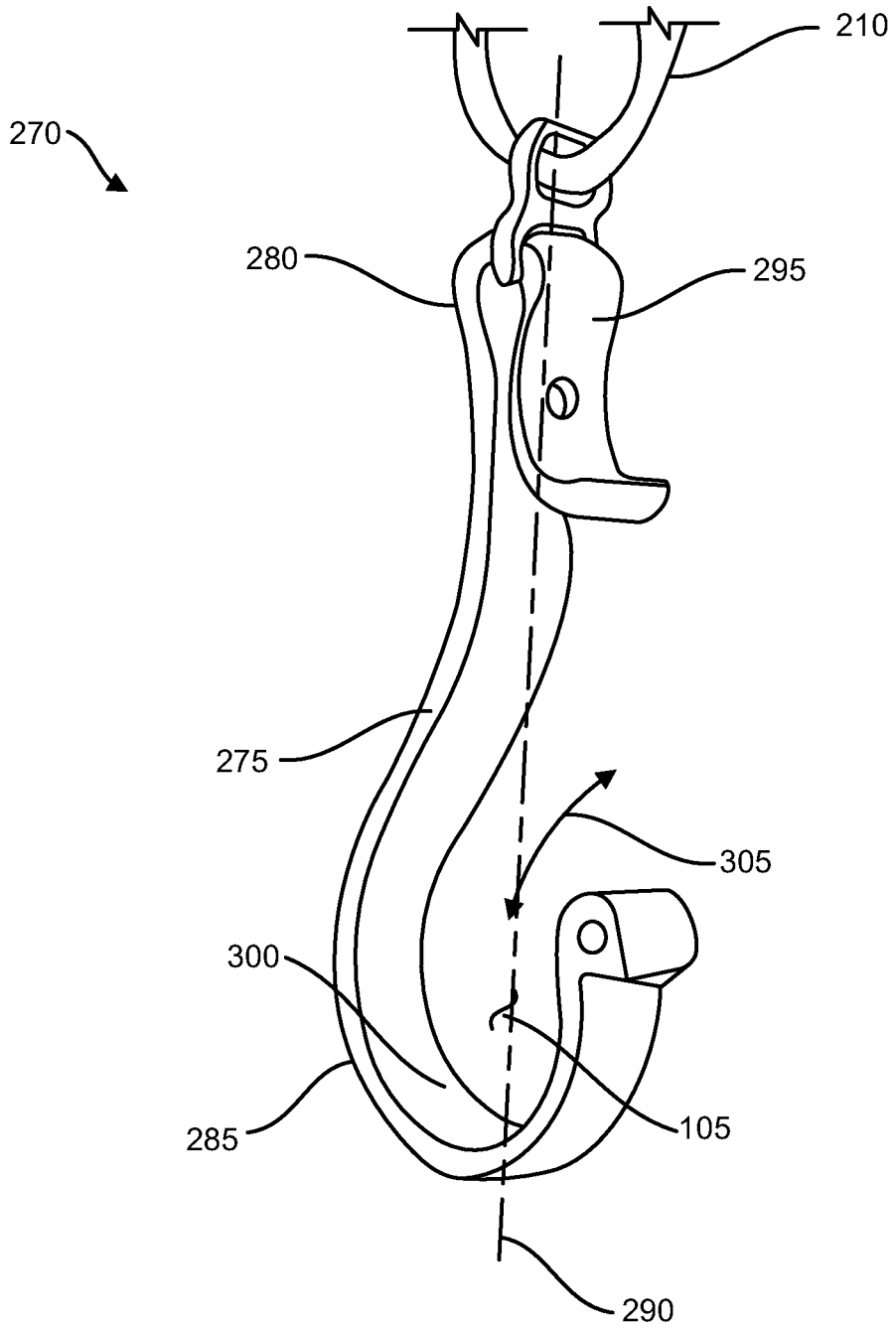
FIG. 5 shows a perspective view of a cradle that includes a leg having a first end portion and an opposing second end portion with a longwise axis spanning therebetween, the leg first end portion having a clasp and the leg second end portion having a flexible hook, with the strap attached to the clasp.

Moving onward, FIG. 5 shows a perspective view of the cradle 270 that includes the leg 275 having the first end portion 280 and the opposing second end portion 285 with the longwise axis 290 spanning therebetween, the leg 275 first end portion 280 having the clasp 295 and the leg 275 second end portion 285 having the open arcuate section 300, with the strap 210 attached to the clasp 295.

Figure 6:
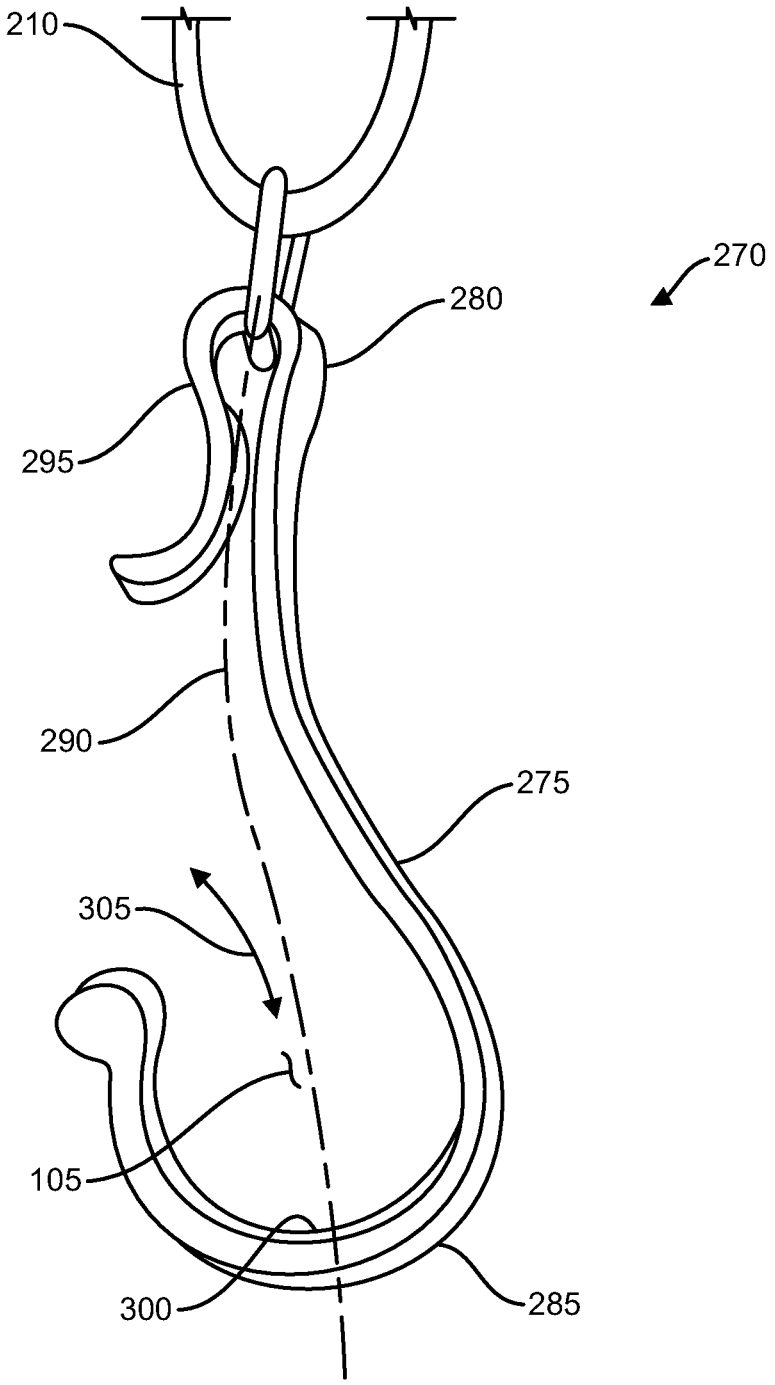
FIG. 6 shows a side elevation view of the cradle that includes the leg having the first end portion and the opposing second end portion with the longwise axis spanning therebetween, the leg first end portion having the clasp and the leg second end portion having the flexible hook, with the strap attached to the clasp.

Continuing further, FIG. 6 shows a side elevation view of the cradle 270 that includes the leg 275 having the first end portion 280 and the opposing second end portion 285 with the longwise axis 290 spanning therebetween, the leg 275 first end portion 280 having the clasp 295 and the leg 275 second end portion 285 having the open arcuate section 300, with the strap 210 attached to the clasp 295.

Next, FIG. 7 shows a perspective view of the luggage towing apparatus 50 in use on the surface 110 with the user 55 pulling 115 the wheeled 100 luggage 95 from their waist 65 (could be a belt also) utilizing the clip 230 in conjunction with the strap 210 and either the cradle 270 or the bracket 120 that is removably engaged 160, 305 to the handle 105 of the wheeled 100 luggage 95, wherein the user 55 is able to pull 115 the wheeled 100 luggage 95 across the surface 110 hands free 80 to enable the user 55 to easily carry a cup of coffee 85 and travel documents 90 for instance.

Further, FIG. 8 shows a perspective view of the luggage towing apparatus 50 in use on the surface 110 with the user 55 pulling 115 the wheeled 100 luggage 95 from their torso 60 (could be over or around the shoulder also) utilizing the strap 210 and either the cradle 270 or the bracket 120 that is removably engaged 160, 305 to the handle 105 of the wheeled 100 luggage 95, wherein the user 55 is able to pull 115 the wheeled 100 luggage 95 across the surface 110 hands free 80 to enable the user 55 to easily carry a cup of coffee 85 and travel documents 90 for instance.

Broadly in looking at FIGS. 1 to 6, the present invention is the luggage towing apparatus 50, wherein the luggage 95 has the wheel 100 to move 115, 225 on the surface 110 and the opposing handle 105, see also FIGS. 7 and 8. The luggage apparatus 50 includes the bracket 120 constructed of the beam 125 having the first end portion 130, the mid portion 135, and the opposing second end portion 140 with the longitudinal axis 145 spanning therebetween, the first end portion 130 having the aperture 150, the second end portion 140 having the flexible hook 155 that is removably engagable 160 to the luggage 95 handle 105, see primarily FIGS. 1 and 2, plus also FIGS. 7 and 8.

Wherein the mid portion 135 has the finger channel 165 constructed of a partial sidewall 170 that is about a channel axis 175 that is perpendicular 180 to the longitudinal axis 145, wherein the partial sidewall 170 terminates in an open gap 185 that operationally allows a user's 55 finger 70 to pass therethrough wherein the sidewall 170 acts as a finger 70 rest 190 to facilitate finger 70 movement 195 thus moving the bracket 120 along the longitudinal axis 145 to engage 200 and disengage 205 the flexible hook 155 from the luggage 95 handle 105, again see primarily FIGS. 1 and 2, plus also FIGS. 7 and 8.

The luggage towing apparatus 50 further includes the strap 210 that is disposed 215 therethrough the aperture 150, wherein operationally the strap 210 is looped 220 around the torso 60 of the user 55 to enable pulling 115, 225 the luggage 95 across the surface 110 hands free 80, see in particular FIG. 8.

In specifically looking at FIG. 7 for the luggage towing apparatus 50, wherein the luggage 95 has a wheel 100 to move 115, 225 on the surface 110 and the opposing handle 105, the luggage apparatus 50 includes the bracket 120 as previously described. Further included is the strap 210 that is disposed 215 therethrough the aperture 150, wherein operationally the strap 210 enables pulling 115, 225 the luggage 95 across the surface 110 hands free 80 by the user 55, again see FIG. 7.

Further included in the luggage towing apparatus 50 as shown in FIG. 7, is the clip 230 constructed of the "U" shaped extension element 235 having the primary end portion 240 and the secondary end portion 245, wherein the secondary end portion 245 terminates in the flexible catch 250 with an adjacent end 255, see in particular FIGS. 3 and 4. Wherein operationally the catch 250 removably engages the strap 210, see FIGS. 3 and 4, and the primary end portion 240 can removably engage 260 the user's 55 hand 75 or can removably engage 265 the pants waist 65 for hands free 80 luggage 95 pulling 115, 225 across the surface 110, see FIG. 7.

In specifically looking at FIG. 7 or 8, for the luggage towing apparatus 50, wherein the luggage 95 has a wheel 100 to move 115, 225 on the surface 110 and the opposing handle 105, the luggage apparatus 50 includes the cradle 270 constructed of the leg 275 having the first end portion 280 and the opposing second end portion 285 with the longwise axis 290 spanning therebetween, the first end portion 280 having the clasp 295 and the second end portion 290 having the flexible open arcuate section 300 that is removably engagable 305 to the luggage 95 handle 105, see in particular FIGS. 5 and 6, plus FIGS. 7 and 8.

Also for the cradle 270 the strap 210 is disposed therethrough the clasp 295, see FIGS. 5 and 6, wherein operationally the strap 210 enables pulling 115, 225 the luggage 95 across the surface 110 hands free 80 by the user 55, see FIGS. 7 and 8.

CONCLUSION

Accordingly, the present invention of a luggage towing apparatus has been described with some degree of particularity directed to the embodiments of the present invention. It should be appreciated, though; that the present invention is defined by the following claims construed in light of the prior art so modifications of the changes may be made to the exemplary embodiments of the present invention without departing from the inventive concepts contained therein.

The invention claimed is:

1. A luggage towing apparatus, wherein the luggage has a wheel to move on a surface and an opposing handle, said luggage apparatus comprising:

(a) a bracket constructed of a beam having a first end portion, a mid portion, and an opposing second end portion with a longitudinal axis spanning therebetween, said first end portion having an aperture, said second end portion having a flexible hook that is removably engagable to the luggage handle, wherein said mid portion has a finger channel constructed of a partial sidewall that is about a channel axis that is perpendicular to said longitudinal axis, wherein said partial sidewall terminates in an open gap that operationally allows a user's finger to pass therethrough wherein said sidewall acts as a finger rest to facilitate finger movement thus moving said bracket along the longitudinal axis to engage and disengage said flexible hook from the luggage handle; and (b) a strap that is disposed therethrough said aperture, wherein operationally said strap is looped around a torso of the user to enable pulling the luggage across the surface hands free.

2. A luggage towing apparatus according to claim 1 wherein said bracket partial sidewall being about said channel axis extends greater than one-hundred eighty (180) degrees in a partial perimeter about said channel axis such that said partial sidewall terminating in said open gap is structured such that each end of said open gap forms an inwardly terminating partial closure distance toward said channel axis that is less than a sidewall maximum distance from said channel axis to operationally increase an area of said finger rest for less finger effort to engage and disengage said flexible hook from the luggage handle.

* * * * *